United States Patent [19]

von der Eltz et al.

[11] 4,351,076

[45] Sep. 28, 1982

[54] PROCESS FOR THE TREATMENT OF TEXTILES IN JET DYEING APPARATUSES

[75] Inventors: Hans-Ulrich von der Eltz, Frankfurt am Main; Albert Reuther, Bad Soden am Taunus, both of Fed. Rep. of Germany

[73] Assignee: Hoechst Aktiengesellschaft, Frankfurt am Main, Fed. Rep. of Germany

[21] Appl. No.: 296,494

[22] Filed: Aug. 26, 1981

Related U.S. Application Data

[63] Continuation of Ser. No. 121,825, Dec. 15, 1980, abandoned.

[30] Foreign Application Priority Data

Feb. 17, 1979 [DE] Fed. Rep. of Germany ..... 2906161
Mar. 30, 1979 [DE] Fed. Rep. of Germany ..... 2912768

[51] Int. Cl.[3] ..... D06B 3/28
[52] U.S. Cl. ..... 8/149.1; 8/149.2; 8/149.3

[58] Field of Search ..... 8/149.1, 149.2, 149.3; 68/5 C, 177, 178

[56] References Cited

U.S. PATENT DOCUMENTS 3,921,420 11/1975 Aurich et al. ..... 68/5 C
3,949,575 4/1976 Turner et al. ..... 68/5 C
4,082,502 4/1978 von der Eltz et al. ..... 68/178 X

*Primary Examiner*—Philip R. Coe
*Attorney, Agent, or Firm*—Curtis, Morris & Safford

[57] ABSTRACT

A process for the treatment of textiles in rope form with gaseous and/or liquid treating agents in a jet dyeing unit, wherein the charging of the jet apparatus with the material rope as well as the material transport in the unit is effected by directing a gas current, especially steam, issuing from nozzles under excess pressure onto the fibrous material. To start the process, the gas current and the fluid current may be used alternately or may be combined. The process is particularly suitable for the isothermal dyeing of textiles in rope form with heat-fixable dyestuffs in accordance with the batchwise exhaustion method.

12 Claims, No Drawings

PROCESS FOR THE TREATMENT OF TEXTILES IN JET DYEING APPARATUSES

This is a continuation of application Ser. No. 121,825 filed Feb. 15, 1980, and now abandoned.

The present invention provides a process for the treating of textiles in rope form and made of natural or synthetic fibers, or mixtures of such fibers, with gaseous and/or liquid agents in a jet dyeing apparatus, which comprises introducing the textiles to be treated into a vessel which can be tightly closed against the surrounding atmosphere, circulating the material in endless form for at least the treatment period, during which period the treating agent is circulated in the same direction to act on the textiles.

Processes of this kind are known in textile industry. It is the principal feature of this mode of operation that the treating liquor in the dyeing apparatus is circulated in a manner that it issues from one or several nozzles and impinges upon the textile in rope form tangentially as the textile passes by the nozzles, thus imparting motion to the textile due to the kinetic energy of the liquor. There results a circulation of the rope similar to that achieved by a winch beck; however, in this case the transport of the material is not effected by the winch turn, but by the liquor circulation and the liquor pressure produced in the nozzles.

From German Offenlegungsschrift No. 26 59 086 there is known a process according to which—in addition to the liquor current causing the transport of the textile goods—a gas current issues from an additional nozzle onto the flow system of goods and liquor to effect the foaming of the liquor which contains a foaming agent. An improved distribution of the liquor in the textile rope is expected.

In all these known treatment processes using the jet dyeing appartus the transport of the textile goods though the treatment zone is reliant on the presence of a fluid (liquor); also the introduction itself of the material into the unit, which is likewise effected via the nozzles, requires the presence of a fluid in the apparatus. A dry charging of the jet apparatus with the fiber material has not previously been possible. However, in certain cases—especially if the material has already been pretreated in a continuous operation or if a pretreatment of this kind has been dispensed with altogether it is required in accordance with the dyeing practice to introduce the textiles in rope form into a jet dyeing apparatus without using a liquid treating medium.

In the same manner it is considered a drawback in the execution of many dyeing and other treatment processes in jet dyeing units that the passage of the goods must be interrupted, or maintained merely by purely mechanical means (winches, rollers), albeit for a short time, whenever the treating liquor is discharged and another liquor is introduced, i.e. each time the bath is changed. Another impairment of the efficiency of such known operating methods resides in the fact that the charging of the dyeing jet with the pretreatment liquor and the goods at the same time, as well as the subsequent heating of the goods by way of steam to reach dyeing temperature, requires separate operating steps.

Finally, with all these known processes the heating of the material can naturally only be effected via the liquor itself.

It is therefore an object of the present invention to provide for material transport into, or within, a jet apparatus not containing any treating liquor or containing less liquor than conventional. This is particularly interesting with wet treatment operations, if a very low goods-to-liquor ratio is to be achieved.

This task is solved according to the invention by imparting the kinetic energy, of gas issuing under excess pressure from a nozzle or plurality of nozzles by impinging on the textile material (in rope form) with same tangentially in the direction of motion, for the transport of the material rope into or through the apparatus.

By employing a gas current as driving means for transport of the textile goods in rope form according to the principle of the present invention, the difficulties resulting from a material transport merely by way of a fluid are surprisingly overcome.

Subjecting the material rope to a jet of gas in a jet dyeing apparatuses according to the invention, also make possible the charging of the unit with the textile goods without a fluid, i.e. without the action of a pretreatment bath, with an empty jet apparatus. For the treatment according to the novel process, the fiber material to be treated may thus be present in a dry or moist state. As gas there is advantageously used in many cases flowing steam, whereby the charging of the dyeing vessel involves at the same time a ventilation of the same as well as an even and rapid heating of the textile goods and the jet piece-dye unit to a temperature corresponding to that of the steam. The subsequent operations in the liquid media may then be carried out isothermally by introducing the treating liquors at the temperature of the heated textile material. Thus, an unnecessary cooling in the intermediate stages of the sequence of individual process steps, and also a re-heating, may be avoided.

A particularly valuable application of the process of the invention lies in the application of heat-fixable dyestuffs in accordance with the batchwise exhaustion method and comprises introducing the textiles to be dyed into a dyeing vessel, ventilating them by steaming and—upon closing said vessel against the surrounding atmosphere—heating them by means of the steam to approximately dyeing temperature, thereafter charging the entire amount of dye liquor at about dyeing temperature and with the aid of excess pressure acting on the liquor into the closed dyeing vessel filled with steam, thus bringing it into contact with the textile goods, and finally carrying out the circulation of the dye liquor as well as the circulation of the textile goods under isothermal conditions. By introducing through the jet nozzle(s) solely, or in part, gas—usually steam—it is also possible to carry out piece-dyeing operations in accordance with the so-called rapid color principle.

In other cases there may be used air or—in cases where the oxygen contained therein might be undesirable—nitrogen as propellant to start or maintain the textile material circulation.

Upon completing the charging of the dyeing vessel with the treating liquor, the transport of the textile goods may be continued both by the treating liquor and the gas current. In general, the process of the invention ensures in the course of the wet treatment a better transport of the material by way of a gas current and through the bath circulation when a circulation pump is employed. Besides subjecting the textile material in rope form in this manner to a jet of a gas as an additional or single measure, it is possible to assist the material circulation in the jet apparatus at the same time mechanically by a driven roller or a roller system.

Due to the above-specified measures and also by means of special steps to ensure improved sliding properties of the textile material at the bottom of the vessel, the invention makes it possible to carry out the treatment process in a very low goods-to-liquor ratio.

An improved sliding behaviour of the dyeing material is achieved by guiding the textiles over a plurality of round rods, polygonal rods or lath-shaped profiles arranged parallel to the direction of the material passage above the basal surface of the vessel.

The smooth surface quality of the above-mentioned sliding-enhancement devices prepared from heat-resistant synthetic material, preferably polytetrafluoroethylene, promotes an even distribution of the goods entering the reservoir and their further transport, thus preventing an undesirable packing of the textiles in places. The outer diameter of the profiles may be in the range of from 0.5 to 5 cm, advantageously from 1.5 to 3 cm. The above-described sliding device is generally arranged 1 to 10 cm above the basal surface of the dyeing vessel, said distance being irrelevant for the execution of the process of the invention, however.

The lateral distance of the rods or profiles from one another is chosen in such a way that depending on the nature of the textiles in rope form a secure passage of the goods is ensured. It is suitably from 1 to 3 cm and may be adjusted to requirements.

The devices and measures according to the process of the invention allow furthermore the discharging and recharging of the treating bath under isothermal and—if not necessary—non-isothermal conditions at a temperature of less or more than 100° C., with a simultaneously continued textile material passage due to the transporting of the textile material by the gas current. This measure, too, results in a considerable reduction of the total treatment period. Undesirable standstills of the goods are avoided.

Moreover, a process operated in this manner makes it possible for the first time to perform successively several heat treatment steps, if necessary even under high-temperature conditions, without a standstill of the goods and without an intermediate cooling of the textile material. Thereby it becomes possible to continue the material transport in the intermediate stages of the process without liquor and without loss of heat. In such a case the material transportis suitably effected—according to the different process stages—by way of the gas current or alternatively by the fluid current, or both may be combined. This variant is particularly advantageous, for example, in alkalization processes of textiles of polyester fibers or filaments and a subsequent dye treatment.

Another advantage of the novel mode of operation is found in processes for dyeing of woven goods containing texturized polyester filaments, wherein an optimum shrinking effect reduces the risk of crease and break formation. The advantages of the process of the invention are still conferred even if the treatment following the first treating bath is not carried out under isothermal conditions.

Within the framework of the process of the invention, the jet dyeing unit, the dyeing apparatus, etc., which are familiar to the expert, are also suitable for executing those treatment operations for the processing of textiles in which, instead of dyestuffs, other finishing agents applied, which remain permanently on the goods are applied. Also processes relating to the pretreatment or aftertreatment of the goods, i.e., above all washing processes, may be carried out in accordance with the novel principle.

The following Examples are only to illustrate the novel process, without restricting the latter in any manner.

EXAMPLE 1

Dry knitted fabric of texturized polyester fiber material in rope form is introduced into a jet dyeing apparatus of known design, the material transport being effected by means of a steam current from the nozzle system at a steam excess pressure adjusted to 1.5 bars (about 128° C.) and with mechanical assistance by a driven roller.

Upon completing the charging process, the fiber material is sewn together in a manner that an endless material rope is formed. Thereafter the inlet opening of the jet dyeing apparatus is closed, and the textiles are circulated once more with the continued use of the steam current (conditions as above). The condensate obtained in the lower part of the dyeing vessel is discharged and collected for re-use. Due to the action of the steam the temperature of the circulating textiles is increased to reach about the temperature of the steam introduced under pressure, and the dyeing vessel itself is filled with steam of the same temperature.

After this treatment of 10 minutes' duration for heating the textile goods, an aqueous dye liquor of about 130° C. which—calculated on the weight of the goods—contains 0.25% of the disperse dye of the formula

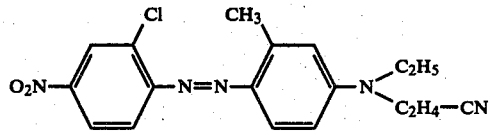

in the form of an aqueous dispersion and which has been adjusted to a pH of about 4.5 is introduced, with the aid of compressed air, from a closed preparing vessel via the nozzles into the dyeing vessel against the vapor pressure (condensation) therein. By the flow of the liquor into the dyeing vessel, the transport of the material rope is maintained and continued—upon completion of the charging process—by the batch circulation with the aid of a circulation pump. During this phase of the treatment the steam flow is reduced. By means of the liquor introduced under pressure, the textile goods being circulated rather rapidly are dyed with a goods-to-liquor ratio of 1:5.5 for 20 minutes at about 130° C.

Subsequently the liquor is discharged via the high temperature outlet. The further transport of the textiles is again taken over by the steam from the nozzles to an increasing degree, to a degree corresponding to the progressive discharging of the dyeing apparatus. Without a standstill of the goods, the first rinsing bath of about 105° C. is introduced into the apparatus. Thereafter the steam supply to the nozzles is discontinued. The material transport is then effected via only the cooling bath. At about 80° C., the commonly used amounts of sodium hydroxide solution, hydrosulfite and auxiliaries are introduced into the bath in order to carry out the reductive purification. After an operating period of about 10 minutes under these conditions said bath is let off again, and the aftertreatment is completed by rinsing with warm (about 50° C.) and cold water.

As a result, there is obtained a completely even red dyeing on the knitted fabric.

EXAMPLE 2

70 kg of dry cotton knitted fabric in rope form are introduced into a jet dyeing apparatus, the material transport being effected by means of a steam current from the nozzle system at a steam excess pressure adjusted to 1 bar (about 120° C.) and simultaneously by the treating liquor likewise fed in via the nozzles. Said liquor is heated to 30° C. in the course of this process and wets the material to be dyed by the mechanical action of steam and water current.

Upon completing the charging process, the current through the nozzles is interrupted, and the knitted fabric is sewn together in a way that an endless material rope is formed. For a short time, solely steam is introduced through the nozzles, and the jet apparatus is thereby ventilated. Thereafter the inlet opening of the dyeing jet is closed, and with the use of further steam current (conditions as above) and by the circulation of the treating liquor the textile fabric is again circulated, until the teperature of the liquor has reached 60° C.

In the course of this process, 1 g/l of a sequestering agent on the basis of ethylene diamine-tetraacetate sodium, 20 $cm^3$/l of 32.5% sodium hydroxide solution and 2.5 g/l of sodium dithionite are added in this order to the aqueous bath, and the pretreatment liquor is subsequently allowed to circulate for 5 minutes for the distribution of the substances. Thereafter 3% of the dyestuff Vat Orange 7 (C.I. No. 71105)—calculated on the weight of the dry goods—which has been suspended in a small amount of water of 40° C. are introduced into the dyeing jet.

With the liquor prepared in this manner the fibrous goods are dyed for 30 minutes at 60° C., in which process the material transport is exclusively due to the circulating liquor.

After the dyeing period the liquor is discharged, whereupon the further transport of the textiles is taken over by steam from the conveyor nozzles as the apparatus is discharged. By introducing cold water, the goods thus dyed are rinsed. The rinsing is thus carried out without any intermediate phase and without a standstill of the material.

The material transport by way of steam is maintained until there is a sufficient amount of water in the apparatus which may then take over such function by itself. As soon as this is the case, the supply of steam to the nozzles is discontinued.

Meanwhile the rinsing water has reached a temperature of 30° C. The dyeing produced is then rinsed until it becomes clear by a further supply of cold water in the overflow. Thereafter the water supply to the dyeing jet is discontinued, the water present in the apparatus is heated to 30° C., and the leuco compound applied to the fiber is oxidized to the vat dye by adding 2 $cm^3$/l of hydrogen peroxide of 33% strength during a treatment of 10 minutes. Thereafter the dyeing is rinsed until it becomes clear by feeding cold water, again without any standstill of the goods.

After drying there is obtained an even orange dyeing of the knitted goods. The dyeing operation thus executed is marked by the following advantages:

Owing to the carrying out one dyeing step after another without any intermediate phase according to the invention, from 20 to 30 minutes of dyeing time are saved. As compared against the conventional methods, the hydrosulfite consumption has been reduced by about 10%.

What is claimed is:

1. In a process for treating a textile material in rope form made of natural or synthetic fibers, or a mixture of such fibers, with a gaseous or liquid treating agent, or mixture of such agents, in a jet wet-processing apparatus, wherein the textile material rope to be treated is introduced into a vessel which can be tightly closed against the surrounding atmosphere and, in endless form, is circulated therein, at least for the duration of the treatment period, during which period the treating agent is circulated in the same direction, thereby effecting transportation of, and simultaneous action on, the textile material rope, the improvement which comprises, instead of transporting the textile material rope, during all of said treatment period, by circulation of the liquid agent with which the textile material rope is in contact and in the process of exhausting, transporting, at least in substantial part, the textile material rope into and through said apparatus and during at least part of said treatment period by means of tangential gas-impingement upon the rope in the direction of motion of the rope, said gas being heated and issuing under pressure from a nozzle or combination of nozzles in said apparatus and said gas, due to its temperature capacity and delivery, being capable of effecting affinity between the treating agent and textile material.

2. The process as claimed in claim 1, which comprises assisting material transport due to said gas-impingement mechanically with a driven roller or a roller system.

3. The process as claimed in claim 1 or 2, which comprises assisting material transport due to said gas-impingement by circulating a liquid treating agent in the direction of material transport.

4. The process as claimed in claim 1 or 2, which comprises continuing material transport by said gas-impingement during discharging and re-charging of a liquid treating agent.

5. The process as claimed in claim 1 or 2, wherein the material transport is effected alternately, from one successive different treatment stage to the next, by the gas or the liquid agent, or by a mixture of gas and liquid agent.

6. The process as claimed in claim 1 or 2, wherein the gas is air or nitrogen.

7. The process as claimed in claim 1 or 2, wherein the gas is steam.

8. The process as claimed in claim 7, which further comprises simultaneously deaerating the textile rope and the treatment vessel with the steam, as well as heating said rope and vessel to approximately the temperature of a subsequent wet treatment operation.

9. The process as claimed in claim 7, wherein the steam is of approximately the same temperature as that of a subsequent wet treatment operation.

10. The process as claimed in claim 9, which further comprises performing an isothermal dyeing operation according to the batchwise exhaustion process following the action of the steam on the textile rope.

11. The process as claimed in claim 7 when used for dyeing with a dyeing liquor which is a liquid treatment agent containing a thermofixable dyestuff, which comprises the steps of:

(a) deaerating, with steam, the textile rope to be dyed directly after the rope has been introduced into the dyeing vessel, or after a preliminary treatment in combination with the introduction of said textile rope into said dyeing vessel;

(b) heating said textile rope to substantially the dyeing temperature with steam after having tightly closed said dyeing vessel against the surrounding atmosphere;

(c) rapidly forcing the entire amount of dyeing liquor, at substantially the dyeing temperature and under an excess pressure, into the closed dyeing vessel containing steam, and contacting said liquor with said textile rope; and (d) dyeing said textile rope by recirculation of said dyeing liquor and circulation of said textile rope under substantially isothermal conditions and under at least autogenous pressure.

12. The process as claimed in claim 1 or 2, which further comprises carrying out several heat treatment operations successively, each by means of a gaseous treating agent, liquid treating agent or mixture of a gaseous treating agent and liquid treating agent, without a standstill and without cooling of the textile rope, under isothermal conditions.

* * * * *